US008761345B2

(12) United States Patent
Shimono

(10) Patent No.: US 8,761,345 B2
(45) Date of Patent: Jun. 24, 2014

(54) X-RAY TUBE

(75) Inventor: Takashi Shimono, Tochigi-ken (JP)

(73) Assignees: Toshiba Electron Tubes & Devices Co., Ltd., Tochigi-Ken (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/457,965

(22) Filed: Apr. 27, 2012

(65) Prior Publication Data

US 2012/0207279 A1 Aug. 16, 2012

Related U.S. Application Data

(63) Continuation of application No. PCT/JP2010/006235, filed on Oct. 21, 2010.

(30) Foreign Application Priority Data

Oct. 30, 2009 (JP) ..... 2009-250901

(51) Int. Cl.
*H01J 35/12* (2006.01)

(52) U.S. Cl.
USPC ..... 378/140; 378/141

(58) Field of Classification Search
USPC ..... 378/140, 141
See application file for complete search history.

(56) References Cited

U.S. PATENT DOCUMENTS

| | | | | |
|---|---|---|---|---|
| 4,964,148 | A * | 10/1990 | Klostermann et al. | 378/127 |
| 5,185,774 | A * | 2/1993 | Klostermann | 378/125 |
| 2005/0201523 | A1 * | 9/2005 | Daniel et al. | 378/200 |
| 2011/0235781 | A1 * | 9/2011 | Aoki et al. | 378/62 |

FOREIGN PATENT DOCUMENTS

| | | |
|---|---|---|
| JP | 08-096889 | 4/1996 |
| JP | 2001-504988 | 4/2001 |
| JP | 2007-042434 | 2/2007 |
| JP | 2008-293868 | 12/2008 |

* cited by examiner

*Primary Examiner* — Hoon Song
*Assistant Examiner* — Dani Fox
(74) *Attorney, Agent, or Firm* — Pillsbury Winthrop Shaw Pittman, LLP

(57) ABSTRACT

An X-ray tube has a cathode, an anode target to emit X-rays, and a vacuum envelope which houses the cathode and the anode target. The vacuum envelope has a first metal member connected to the anode target, a second metal member which is connected to the first metal member and has a coefficient of thermal expansion lower than that of the first metal member, and an electrically insulating annular ceramic member connected to the second metal member and the cathode. In addition, the X-ray tube has a cooling system which is connected to the first metal member and forms a cooling passage. Furthermore, the X-ray tube has an adapter which is in contact with the first metal member, surrounds the second metal member and has a thermal conductivity higher than that of the second metal member, and a heat-transfer medium placed between the ceramic member and the adapter.

13 Claims, 3 Drawing Sheets

X-RAY TUBE

CROSS-REFERENCE TO RELATED APPLICATION(S)

This application is a Continuation Application of PCT Application No. PCT/JP2010/006235, filed Oct. 21, 2010 and based upon and claims the benefit of priority from the prior Japanese Patent Application No. 2009-250901, filed on Oct. 30, 2009, the entire contents of all of which are incorporated herein by reference.

FIELD

An embodiment of the present invention relates to an X-ray tube which generates X-rays.

BACKGROUND

An X-ray tube is, generally, used for a system which sees through the inside of human bodies or goods, such as a medical diagnosis system and an industrial diagnosis system. The X-ray tube has a cathode, an anode target and a vacuum envelope which houses the cathode and the anode target therein. By applying a high voltage between the cathode and the anode target, electrons emitted from the cathode side impinge on the anode target and thereby X-rays emanate from the anode target.

When the electrons emitted from the cathode impinge on the anode target, the anode target is heated and becomes high temperature. In addition, the cathode also becomes high temperature because a filament is heated so that the cathode emits thermal electrons. When a high-voltage plug is connected to the cathode and a high voltage is applied between the cathode and the anode target, heat of the cathode transfers the high-voltage plug and an insulating part of the high-voltage plug deforms. Accordingly, there is a possibility that a dielectric breakdown may arise.

JP, PH08-96889A discloses a high-voltage connector of a form provided in order to cover onto and be inserted into a high-voltage connection portion provided in a vacuum casing of an X-ray tube. JP, PH08-96889A also discloses that the high-voltage connector has a cooling channel for coolant.

JP, P2008-293868A discloses a structure having a housing and a high-thermal-conductivity insulating member. The housing houses a high-voltage cable end and a high-voltage terminal, and insulates and holds them with an insulating sealing member filled up inside thereof. The high-thermal-conductivity insulating member is fixed to an inner wall of the housing, contacts to the high-voltage terminal thermally and has a larger thermal conductivity than that of the insulating sealing member. JP, P2008-293868A also discloses that the high-thermal-conductive insulating member releases heat, which is transferred from the anode via the high voltage terminal, to the housing.

JP, P2007-42434A discloses that a support member is held by a connection portion which is connected to a tube container at one end side of the support member projected from an envelope and between the envelope and a power feeding part, and discloses that heat accumulated in an insulating material is released via the support member in contact with the insulating material.

JP, P2007-42434A further discloses that heat of the support member transfers to the insulating material and the tube container, and becomes easy to be released from the tube container, the heat release characteristic of the support member improves, and, thereby temperature of the power feeding part can be lowered.

JP, P2001-504988A discloses an X-ray tube of which a high-voltage insulating member is surrounded by potting material and an external surface of the potting material is cooled.

DETAILED DESCRIPTION

According to an embodiment, there is provides an X-ray tube provided with a cathode, an anode target, a vacuum envelope which houses the cathode and the anode target therein, an adapter, a heat-transfer medium, and a cooling system which forms a cooling passage through which coolant flows.

The cathode emits thermal electrons. The anode target emits X-rays by incidence of the electrons emitted from the cathode.

The vacuum envelope has a first metal member, a second metal member, and an electrically insulating ceramic member. The first metal member is connected to the anode target and extends in a direction along a tube axis of the X-ray tube. The first metal member has an X-ray radiation window. The second metal member is connected to the first metal member and extends in the direction along the tube axis. The second metal member has a coefficient of thermal expansion lower than a coefficient of thermal expansion lower of the first metal member. The ceramic member is connected to both the second metal member and the cathode. The ceramic member is formed annularly, projects from the cathode in a direction perpendicular to the tube axis, and shows electrical insulation properties.

The adapter is placed so as to contact the first metal member, and surrounds the second metal member. The adapter has a thermal conductivity higher than a thermal conductivity of the second metal member. The heat-transfer medium is placed between the ceramic member and the adapter. The cooling system is connected to the first metal member. Heat released from the anode target is conducted to the cooling system directly or indirectly via the first metal member. In addition, heat released from the cathode is conducted to the cooling system indirectly via the ceramic member, the heat-transfer medium, the adapter, and the first metal member.

When cooling the anode target and the cathode, it is necessary to cool the anode target and the cathode independently. For this reason, previously, a complicated mechanism for cooling was required. Therefore, it has been desired a technology which is capable of releasing efficiently outside both the heat generated at the anode target and the heat generated at the cathode with simple structure.

The X-ray tube of the embodiment is capable of releasing efficiently outside the heat generated at the cathode and the heat generated at the anode target with simple structure.

Hereinafter, the X-ray tube of one embodiment is explained in detail with reference to the drawings.

Figure 1:
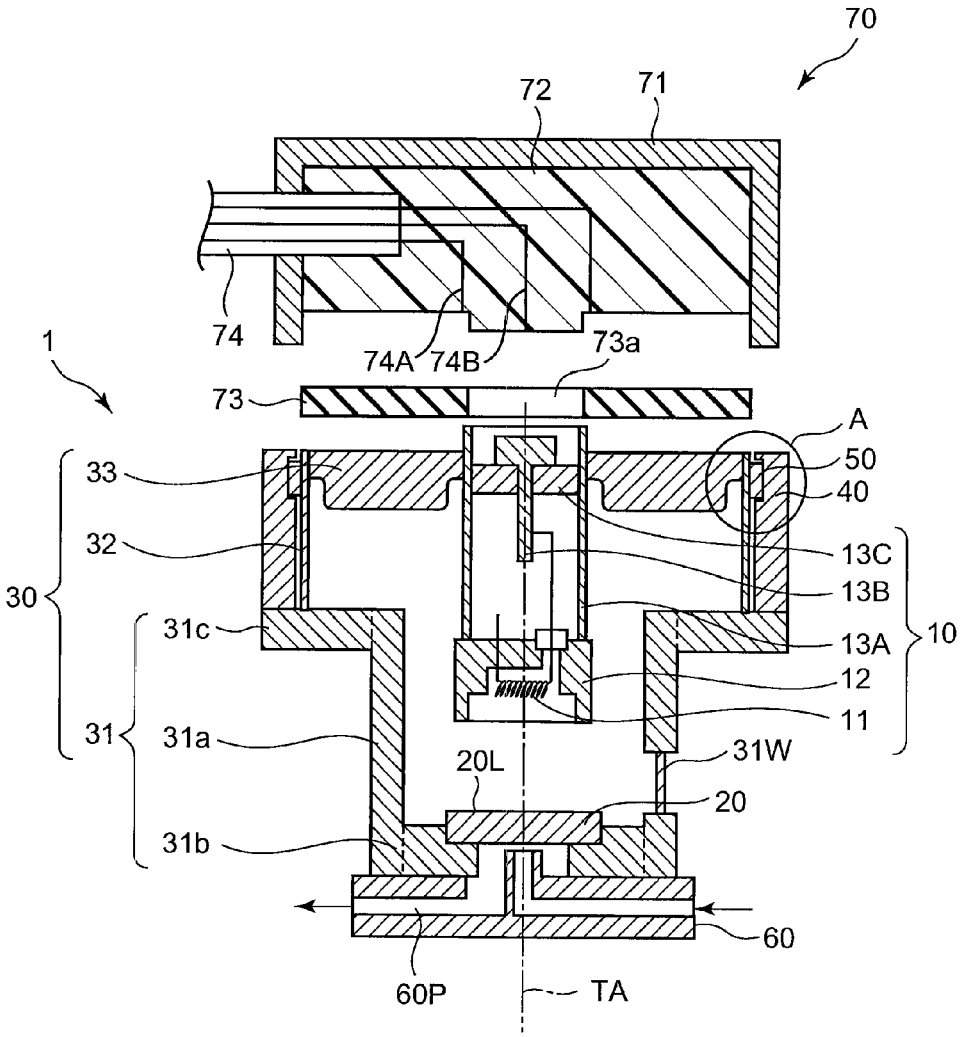
FIG. 1 is a sectional view showing schematically structure of an X-ray tube concerning one embodiment, and shows a section of a high-voltage plug which is connected to the X-ray tube.

As shown in FIG. 1, the X-ray tube 1 has a cathode 10, an anode target 20 and a vacuum envelope 30 which houses the cathode 10 and the anode target 20 therein. In the FIG. 1, a symbol TA denotes a tube axis of the X-ray tube.

The cathode 10 has a filament 11 as an electron emission source and a focusing electrode 12. The filament 11 emits thermal electrons which impinge on the anode target 20. The focusing electrode 12 is placed so as to surround orbits of the electrons emitted from the filament 11 and focuses the electrons emitted from the filament 11. A high voltage which is negative with respect to the anode target 20 and a filament current which heats the filament 11 are supplied to the cathode 10 from an external electric power source which is not illustrated.

The anode target 20 is placed so as to face the cathode 10. The anode target 20 is formed of high melting point metal, such as molybdenum (Mo) and tungsten (W). The anode target 20 includes a target layer 20L in a side which faces the cathode 10. The electrons impinge on the target layer 20L. A voltage which is positive with respect to the cathode 10 is applied to the anode target 20. The potential difference generated between the anode target 20 and the cathode 10 accelerates and focuses the electrons which are emitted from the cathode 10. The accelerated electrons impinge the anode target 20, and thereby the anode target 20 emits X-rays.

The vacuum envelope 30 houses the cathode 10 and the anode target 20. The vacuum envelope 30 is sealed airtightly. The vacuum envelope 30 maintains the inside in a vacuum state. That is, the vacuum envelope 30 holds the cathode 10 and the anode target 20 in a vacuum. The vacuum envelope 30 includes a first metal member 31, a second metal member 32 and a ceramic member 33.

The first metal member 31 is a cylinder of which central axis is a tube axis TA, and extends in the direction along the tube axis TA. The first metal member 31 is placed so as to surround the cathode 10 and the anode target 20. In detail, the first metal member 31 includes a cylinder part 31*a*, a board part 31*b* which is connected to one end of the cylinder part 31*a* and has an opening, and a ring part 31*c* which is connected to the other end of the cylinder part 31*a*. These are formed in one. The anode target 20 is connected to the board part 31*b* so as to close the opening of the board part 31*b* at the vacuum side. The first metal member includes an X-ray radiation window 31W. The cylinder part 31*a* has an opening, and the X-ray radiation window 31W is provided so as to close the opening.

The X-ray emitted from the anode target 20 penetrates the X-ray radiation window 31W.

The second metal member 32 is formed in a shape of a cylinder of which central axis is the tube axis TA, and extends in the direction along the tube axis TA. The second metal member 32 is placed concentrically to the first metal member 31, and is connected to the ring part 31*c* of the first metal member 31. It is needless to say that a place where the second metal member 32 is connected to the first metal member 31 is neither an outer surface nor an internal surface of the ring part 31*c*, nor an internal surface of the cylinder part 31*a*. The second metal member 32 is connected to a major surface of the ring part 31*c*. The second metal member 32 surrounds the cathode 10 partially along the tube axis TA. A thickness of the second metal member 32 is small. The thickness of the second metal member 32 is smaller than a length of the second metal member 32 along the tube axis TA. In order to join the second metal member 32 to the ceramic member 33 which has a low coefficient of thermal expansion mentioned later, the second metal member 32 is formed of metal which has a coefficient of thermal expansion lower than a coefficient of thermal expansion of the first metal member 31, for example, kovar.

The ceramic member 33 is placed so as to close one end of the second metal member 32, and is airtightly connected to the second metal member 32 and the cathode 10. The ceramic member 33 shows electrical insulating properties, and has a low coefficient of thermal expansion. A coefficient of thermal expansion of the ceramic member 33 is smaller than that of the first metal member 31 and that of the second metal member 32. The ceramic member 33 is formed annularly and projects in a direction perpendicular to the tube axis TA from the external surface of the cathode 10. A surface opposite to a vacuum side surface of the ceramic member 33 is flat.

The cathode 10 further includes a first cathode lead-in terminal 13A and a second cathode lead-in terminal 13B. The first cathode lead-in terminal 13A is cylindrical, and the second cathode lead-in terminal 13B is rod-shaped. Each end of the first cathode lead-in terminal 13A and second cathode lead-in terminal 13B is connected to the filament 11, and the first cathode lead-in terminal 13A is also connected to the focusing electrode 12. Each other end of the first cathode lead-in terminal 13A and second cathode lead-in terminal 13B is fixed to a cathode ceramic member 13C. The external surface of the first cathode lead-in terminal 13A is connected to the ceramic member 33. Each other end of the first cathode lead-in terminal 13A and second cathode lead-in terminal 13B extends to the outside of the vacuum envelope 30. The first cathode lead-in terminal 13A, the second cathode lead-in terminal 13B and the second metal member 32 are electrically insulated by the ceramic member 33.

That is, the ceramic member 33 is a high-voltage insulation member which insulates electrically the cathode 10 and the anode target 20 connected to the second metal member 32.

The X-ray tube 1 is further provided with an adapter 40 and a heat-transfer medium 50.

Figure 2:
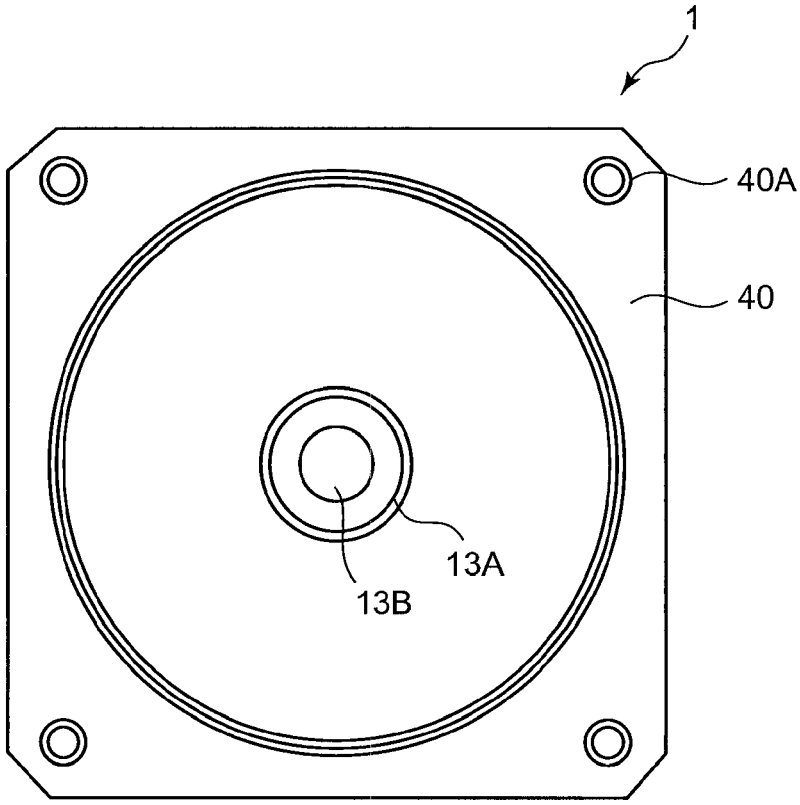
FIG. 2 is a top view of the X-ray tube shown in FIG. 1.
Figure 3:
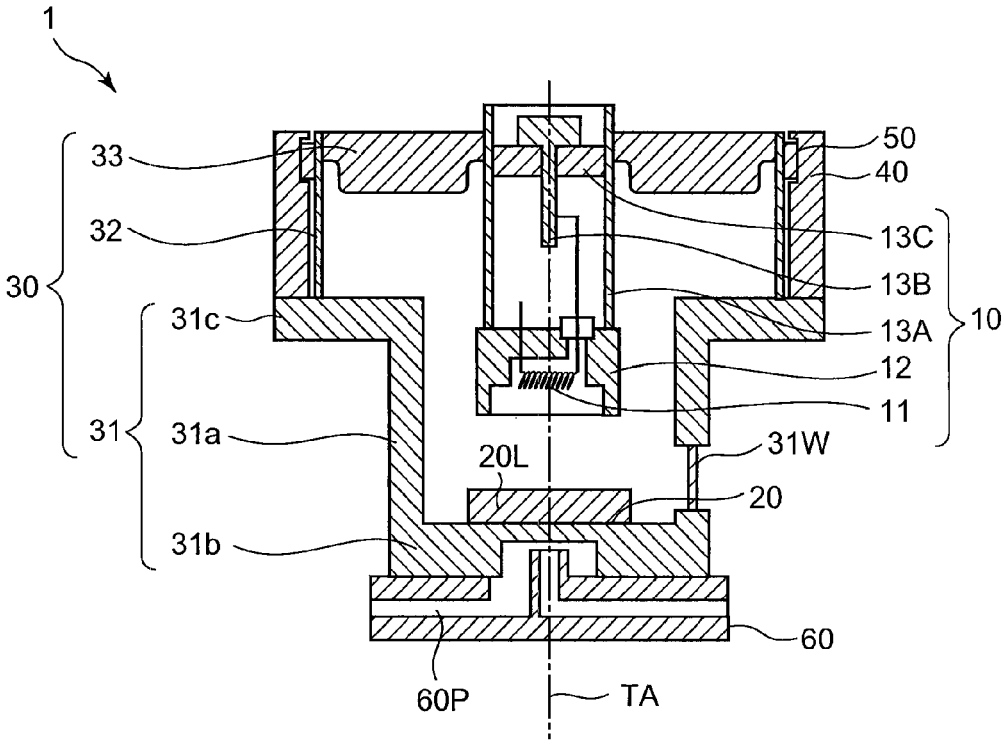
FIG. 3 is a sectional view showing schematically structure of an X-ray tube concerning another embodiment.

The adapter 40 is placed on the ring part 31*c* of the first metal member 31. The adapter 40 surrounds the second metal member 32 along the tube axis TA. The adapter 40 is cylindrical and extends in the direction along the tube axis TA. One end of the adapter 40 is in contact with the ring part 31*c* of the first metal member 31. The adapter 40 is soldered or screwed to the ring part 31*c*, for example, in order to fix the adapter 40 to the first metal member 31. Furthermore, the adapter 40 has a flange at the other end so that an outer shape becomes approximately square, as shown in FIG. 2. Screw holes 40A are formed in the flange for fixing a high-voltage plug 70 for applying a high voltage between the cathode 10 and the anode target 20. The adapter 40 has a thermal conductivity higher than a thermal conductivity of the second metal member 32. The adapter 40 is formed of a metal of high thermal conductivity, such as copper (Cu), brass, or aluminum (Al).

The heat-transfer medium 50 is placed between the ceramic member 33 and the adapter 40, and is in contact with the second metal member 32 and the adapter 40. That is, the ceramic member 33 and the heat-transfer medium 50 face each other to sandwich the second metal member 32 in a thickness direction of the second metal member 33. The heat-transfer medium 50 is formed of a material which has a high thermal conductivity, for example, copper (Cu). In order to ensure contact between the adapter 40 and the second metal member 32, it is desired that the heat-transfer medium 50 is a metal of mesh shape, or a metal of a shape which has characteristic of a spring.

The X-ray tube 1 is further provided with a cooling system 60 which cools the anode target 20. A part of the cooling system 60 is connected to the first metal member 31 of the vacuum envelope 30. The cooling system 60 forms a cooling passage 60P through which coolant flows. The coolant contacts the first metal member 31 and the anode target 20 directly. Heat which the anode target 20 generates is directly transferred to the coolant. In addition, heat which the cathode generates is indirectly transferred to the coolant via the ceramic member 33, the second metal member 52, the heat-transfer medium 50, the adapter 40, and the first metal member 31. The coolant is pure water, water solution, or insulating oil, for example. The pure water and water solution have high thermal conductivities as compared with the insulating oil. For this reason, when the pure water and water solution are used as cooling water, the anode target 20 can be cooled more. It should be noted that a main ingredient of the water solution is water.

The high-voltage plug 70 supplies a high voltage and a filament current which heats the filament 11 to the cathode 10 from an external power source which is not illustrated. The high-voltage plug 70 includes a lid part 71, epoxy resin 72 filled up in the lid part 71, a silicone plate 73 as an electric insulating material located between the epoxy resin 72 and the ceramic member 33, and a high-voltage cable 74. The silicone plate 73 has an opening 73*a*.

The high-voltage cable 74 is covered by the epoxy resin 72, and faces the first cathode lead-in terminal 13A and the second cathode lead-in terminal 13. The first cathode lead-in terminal 13A and the second cathode lead-in terminal 13B are connected to a first conductor 74A and a second conductor 74B of the high-voltage cable 74 via the opening 73A of the silicone plate 73. The silicone plate 73 is in close contact with the ceramic member 33.

The high-voltage plug 70 is connected to the cathode 10 at the time of operation of the X-ray tube 1. That is, the high-voltage plug 70 is connected to the first cathode lead-in terminal and second cathode lead-in terminal which extend from the vacuum envelope 30. The high voltage-plug 70 is fixed to the adapter 40 by use of the screw holes 40A bored in the adapter 40 and screws which are not illustrated. A voltage which is positive with respect to the cathode 10 is applied to the anode target 20. Here, the anode target 20 is grounded. Furthermore, the first conductor 74A and the second conductor 74B of the high-voltage plug 70 are connected to the first cathode lead-in terminal 13A and the second cathode lead-in terminal 13B respectively. The first conductor 74A and the second conductor 74B supply the filament current to the filament 11 via the first cathode lead-in terminal 13A and the second cathode lead-in terminal 13B, and apply a high voltage which is negative with respect to the anode target 20 to the filament 11 and the focusing electrode 12. Thereby, the high voltage is applied between the cathode 10 and the anode target 20, the electrons emitted from the filament 11 impinge on the anode target 20, and X-rays occur. The generated X-rays are emitted to the exterior from the X-ray radiation window 31W.

Since the anode target 20 is in contact with the coolant, the heat generated by the impingement of the electrons to the anode target 20 is released to the exterior of the X-ray tube 1 via the coolant.

On the other hand, the heat generated at the cathode 10 is transferred to the ceramic member 33 via the first cathode lead-in terminal 13A and the second cathode lead-in terminal 13B. Since the second metal member 32 is formed of the metal of a low thermal conductivity, such as kovar, the heat transferred to the ceramic member 33 cannot adequately be transferred to the first metal member 31 via the second metal member 32. However, since the heat-transfer medium 50 has a high thermal conductivity, the heat transferred to the ceramic member 33 from the cathode 10 is transferred to the first metal member 31 via the second metal member 32, the heat-transfer medium 50 and the adapter 40. The heat transferred to the first metal member 31 is released to the exterior of the X-ray tube 1 via the coolant. That is, the heat generated at the cathode 10 is released to the exterior of the X-ray tube 1 via the ceramic member 33, the second metal member 32, the heat-transfer medium 50, the adapter 40, and the first metal member 31 and via further the coolant of the cooling system 60

As explained above, the X-ray tube of this embodiment can release efficiently outside the heat generated at the cathode and the heat generated at the anode target by a simple structure. Furthermore, thereby, a connection portion between the X-ray tube 1 and the high-voltage plug 70 can be cooled, and deformation of an insulating part of the high-voltage plug 70 can be prevented. Therefore, according to this embodiment, stabilization of high-voltage connection between the X-ray tube 1 and the high-voltage plug 70 can be secured, and a reliable X-ray tube can be obtained.

Furthermore, the X-ray tube according to the above-mentioned embodiment can release the heat generated at the cathode 10 without extending the cooling passage 60P of the cooling system 60, which cools the anode target 20, to the cathode 10. That is, the heat generated at the cathode 10 and the heat generated at the anode target 20 are efficiently released outside by one cooling system 60 without changing the size of the X-ray tube 1.

Figure 4:
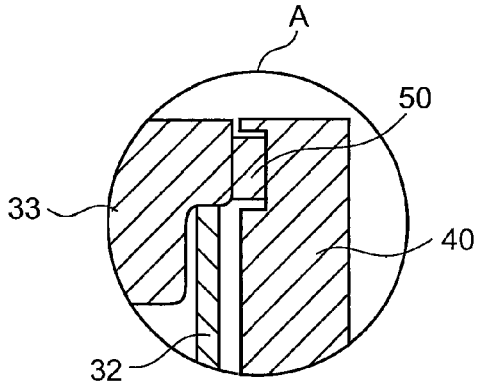
FIG. 4 is an enlarged sectional view of area A shown in FIG. 1 of an X-ray tube concerning a still another embodiment.

In the above-mentioned embodiment, the heat-transfer medium 50 is placed so as to be in contact with the second metal member 32. The heat-transfer medium 50, however, may be placed so as to be in contact with the ceramic member 33 as shown in FIG. 4. In this case, the second metal member 32 is also airtightly connected to the ceramic member 33. Since the second metal member 32 does not intervene between the ceramic member 33 and the heat-transfer medium 50, the heat generated at the cathode 10 is efficiently transferred to the first metal member 31, and is released by the cooling system 60.

In the above-mentioned embodiment, the first metal member 31 of the vacuum envelope 30 is formed approximately cylindrical, and is connected to the anode target 20. The first metal member 31, however, does not need to be formed cylindrical and is variously deformable. The opening formed in the board part 31*b* may be closed. In this case, the anode target 20 is placed on the board part 31*b* of the first metal member 31 at the vacuum side. Since the heat generated at the anode target 20 is conducted to the coolant via the board part 31*b* of the first metal member 31, the same effective result as the above-mentioned embodiment is attained.

The above-mentioned embodiment explains the X-ray tube in which the first metal member 31 of the vacuum envelope 30 has one X-ray radiation window 31W. The X-ray tube, however, may have two or more X-ray radiation windows 31W. The X-ray tube which has two or more X-ray radiation windows 31W can radiate X-rays in two or more directions.

There is a big difference between thermal expansion coefficients of the first metal member 31 and the second metal member 32. If the first metal member 31 and the second metal member 32 are hard to be joined, making thin the thickness (difference of an inside diameter and an outer diameter) of the second metal member 32 enables to maintain the airtightness between the first metal member 31 and the second metal member 32. In order to conduct heat efficiently, it is preferred that the thickness of the cylindrical part of the adapter 40 is large. Accordingly, the thickness of the adapter 40 is larger than that of the second metal member 32.

In the above-mentioned embodiment, the ceramic member 33 is formed annularly so as to spread on one plane perpendicular to the tube axis TA. For this reason, compared with an X-ray tube whose ceramic member is not flat, a full length of the X-ray tube 1 can be shortened, and the X-ray tube 1 can be small in size. The X-ray tube can release efficiently the heat generated at the cathode 10 because the conduction path of the heat from the cathode 10 to the adapter 40 can be shortened. Furthermore, according to the above-mentioned embodiment, since a surface opposite to the vacuum side surface of the ceramic member 33 is formed evenly, the X-ray tube 1 can be small in size.

As explained above, the present invention can provide an X-ray tube which can release efficiently outside heat generated at a cathode and heat generated at an anode target a simple structure.

Several embodiments of the present invention are described above. Such embodiments are shown as examples and they are not intended to limit a scope of the invention. These new embodiments can be carried out with other various forms. Various abbreviation and replacement and modification can be performed within the scope on the invention. These embodiments and the modifications thereof are included in the scope of the invention, and are included in the inventions described in the claims and their equivalent scopes.

What is claimed is:

1. An X-ray tube, comprising:

a cathode to emit electrons;

an anode target to emit X-rays by incident electrons emitted from the cathode;

a vacuum envelope housing the cathode and the anode target, the vacuum envelope including:

a first metal member connected to the anode target and extending in a direction along a tube axis of the x-ray tube, the first metal member having an X-ray radiation window;

a second metal member connected to the first metal member, extending in a direction along the tube axis, and having a coefficient of thermal expansion lower than that of the first metal member; and an electrically insulating annular ceramic member connected to the second metal member and the cathode, and projecting from the cathode in a direction perpendicular to the tube axis; and an adapter placed so as to be in contact with the first metal member, and surrounding the second metal member outside the vacuum envelope, and having a thermal conductivity higher than that of the second metal member;

a heat-transfer medium placed between the ceramic member and the adapter, outside the vacuum envelope; and a cooling system connected to the first metal member and forming a cooling passage through which coolant flows, wherein heat released from the anode target is conducted to the cooling system directly or indirectly via the first metal member, and heat released from the cathode is conducted to the cooling system indirectly via the ceramic member, the heat-transfer medium, the adapter, and the first metal member.

2. The X-ray tube according to claim 1, wherein the coolant is pure water.

3. The X-ray tube according to claim 1, wherein the coolant is water solution whose main ingredient is water.

4. The X-ray tube according to claim 1, wherein the anode target is in contact with the coolant.

5. The X-ray tube according to claim 1, wherein the first metal member is in contact with the coolant.

6. The X-ray tube according to claim 1, wherein the ceramic member and the heat-transfer medium face each other to sandwich the second metal member therebetween in a thickness direction of the second metal member.

7. The X-ray tube according to claim 1, wherein the heat-transfer medium is in contact with the ceramic member.

8. The X-ray tube according to claim 1, wherein a thickness of the adapter is larger than that of the second metal member.

9. The X-ray tube according to claim 1, wherein the heat-transfer medium is a metal formed in mesh.

10. The X-ray tube according to claim 1, wherein the heat-transfer medium is a metal formed in a shape which has characteristic of a spring.

11. The X-ray tube according to claim 1, wherein a surface opposite to a vacuum side surface of the ceramic member is flat.

12. The X-ray tube according to claim 1, wherein the anode is grounded.

13. The X-ray tube according to claim 12, wherein the cathode has a filament, and a first cathode lead-in terminal and a second cathode lead-in terminal which are connected to the filament, the first cathode lead-in terminal and the second cathode lead-in terminal extend to the outside of the vacuum envelope, and a high voltage-plug which supplies the high voltage to the cathode is connected to the first cathode lead-in terminal and the second cathode lead-in terminal extending the outside of the vacuum envelopes.

* * * * *